US010833434B1

(12) United States Patent
Tassell, Jr.

(10) Patent No.: US 10,833,434 B1
(45) Date of Patent: Nov. 10, 2020

(54) TERMINAL BLOCK COVER WITH GUIDED PROBE ACCESS

(71) Applicant: Schweitzer Engineering Laboratories, Inc., Pullman, WA (US)

(72) Inventor: Gordon J. Tassell, Jr., Colfax, WA (US)

(73) Assignee: Schweitzer Engineering Laboratories, Inc., Pullman, WA (US)

( * ) Notice: Subject to any disclaimer, the term of this patent is extended or adjusted under 35 U.S.C. 154(b) by 0 days.

(21) Appl. No.: 16/574,873

(22) Filed: Sep. 18, 2019

(51) Int. Cl.
*H01R 9/22* (2006.01)
*H01R 9/24* (2006.01)

(52) U.S. Cl.
CPC ..... *H01R 9/223* (2013.01); *H01R 9/2416* (2013.01)

(58) Field of Classification Search
CPC ..... H01R 9/2416; H01R 9/24; H01R 9/223; H01R 13/447; G01R 1/06794
See application file for complete search history.

(56) References Cited

U.S. PATENT DOCUMENTS 8,608,504 B2 * 12/2013 Tseng ..... H01R 9/034 439/326
8,632,359 B2 1/2014 Grimm
9,306,334 B2 * 4/2016 Zhu ..... H05K 1/0219
9,570,861 B2 * 2/2017 Thackston ..... H01R 12/62
9,698,544 B2 * 7/2017 Wu ..... H01R 13/7175
9,774,111 B2 * 9/2017 Liang ..... H01R 12/57
9,843,143 B2 * 12/2017 Wu ..... H01R 13/665
9,979,145 B2 * 5/2018 Wu ..... H01R 24/60
10,063,018 B2 * 8/2018 Xing ..... H01R 13/7172
10,211,552 B2 * 2/2019 Zhu ..... H01R 13/5833
10,333,263 B2 * 6/2019 Wu ..... H01R 24/64
10,348,010 B2 * 7/2019 Wu ..... H01R 12/778
2006/0228935 A1 * 10/2006 Wen ..... H01R 13/6474 439/497
2011/0151716 A1 * 6/2011 Kondo ..... H01R 13/6471 439/607.01
2016/0079689 A1 * 3/2016 Wu ..... B23K 26/22 439/581
2016/0079714 A1 * 3/2016 Wu ..... H01R 13/6585 439/607.05
2017/0040749 A1 * 2/2017 Tsai ..... H01R 13/6587
2018/0261956 A1 * 9/2018 Yamaguchi ..... H01R 13/5804
2019/0393656 A1 * 12/2019 Wu ..... H05K 1/00

* cited by examiner

*Primary Examiner* — Briggitte R. Hammond
(74) *Attorney, Agent, or Firm* — Fletcher Yoder, P.C.; Bradley W. Schield

(57) ABSTRACT

A cover for a terminal block a cover for a terminal block includes a cover plate that may be disposed over a number of terminals of the terminal block. The cover plate includes a first surface, a second surface configured to face the terminals, and a number of access holes extending between the first surface and the second surface. Each of the access holes enables access to a respective terminal through the cover plate. The cover plate also includes a number of probe guides extending from the second surface of the cover plate toward respective access holes. Each probe guide includes a channel that guides a probe to an operating position that enables the probe to analyze the respective terminal.

19 Claims, 9 Drawing Sheets

TERMINAL BLOCK COVER WITH GUIDED PROBE ACCESS

FIELD OF DISCLOSURE

The present disclosure relates generally to the field of terminal blocks. More specifically, examples of the present disclosure relate to covers for terminal blocks that provide guided probe access to terminals.

BACKGROUND

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Terminal blocks are electrical connectors that couple a current-carrying wire or component to a suitable electrical circuit or a grounding system. The terminal blocks may be utilized in many electronic systems, including computer systems, building systems, power distribution systems, and so forth. To ensure an appropriate electrical connection, certain terminal blocks are screw terminal blocks that include screws to retain wires within respective terminals of the screw terminal blocks. The screws of such components may carry a significant charge in some situations, such that a cover is desirably positioned over a screw terminal block after the wires are installed to prevent unintentional shorting and manual access to the terminals. However, because the screw terminal block may be periodically probed to verify the operation of individual terminals of the screw terminal block, the cover may unfortunately complicate such operations.

BRIEF DESCRIPTION

Certain examples commensurate in scope with the originally claimed subject matter are discussed below. These examples are not intended to limit the scope of the disclosure. Indeed, the present disclosure may encompass a variety of forms that may be similar to or different from the examples set forth below.

When introducing elements of various examples of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one example" or "an example" of the present disclosure are not intended to be interpreted as excluding the existence of additional examples that also incorporate the recited features. Furthermore, the phrase A "based on" B is intended to mean that A is at least partially based on B. Moreover, unless expressly stated otherwise, the term "or" is intended to be inclusive (e.g., logical OR) and not exclusive (e.g., logical XOR). In other words, the phrase A "or" B is intended to mean A, B, or both A and B.

In accordance with one example, a cover for a terminal block includes a cover plate that may be disposed over a number of terminals of the terminal block. The cover plate includes a first surface, a second surface configured to face the terminals, and a number of access holes extending between the first surface and the second surface. Each of the access holes enables access to a respective terminal through the cover plate. The cover plate also includes a number of probe guides extending from the second surface of the cover plate toward respective access holes. Each probe guide includes a channel that guides a probe to an operating position that enables the probe to analyze the respective terminal.

In accordance with another example, a terminal block assembly includes a terminal block having a number of terminals that may be coupled to a number of wires, as well as a cover that may be coupled to the terminal block. The cover includes a cover plate that may be disposed over the terminals. The cover plate includes a main body having a number of access holes defined therethrough. The cover plate also includes a number of probe guides extending from the main body. Each probe guide may include a guide structure. The guide structure is formed around a respective access hole at a first end of the guide structure and defines a guide hole at a second end of the guide structure, opposite the first end. Additionally, each probe guide may direct a probe through the respective access hole, through the respective guide hole, and into contact with a respective terminal.

In accordance with another example, a cover for a terminal block includes a cover plate that may be disposed over a first terminal and a second terminal of the terminal block. The cover plate includes a main body having a first access hole and a second access hole defined therethrough. The first access hole is configured to align with the first terminal and the second access hole is configured to align with the second terminal. The cover plate also includes a first probe guide extending from a surface of the main body toward the first access hole and a second probe guide extending from the surface of the main body toward the second access hole. The first probe guide and the second probe guide each may be able to guide a probe to an operating position and retain the probe in the operating position to enable the probe to analyze the first terminal or the second terminal, respectively, for a duration of a measurement operation.

DRAWINGS

These and other features, aspects, and advantages of the present disclosure will become better understood when the following detailed description is read with reference to the accompanying drawings in which like characters represent like parts throughout the drawings, wherein.

Figure 8:
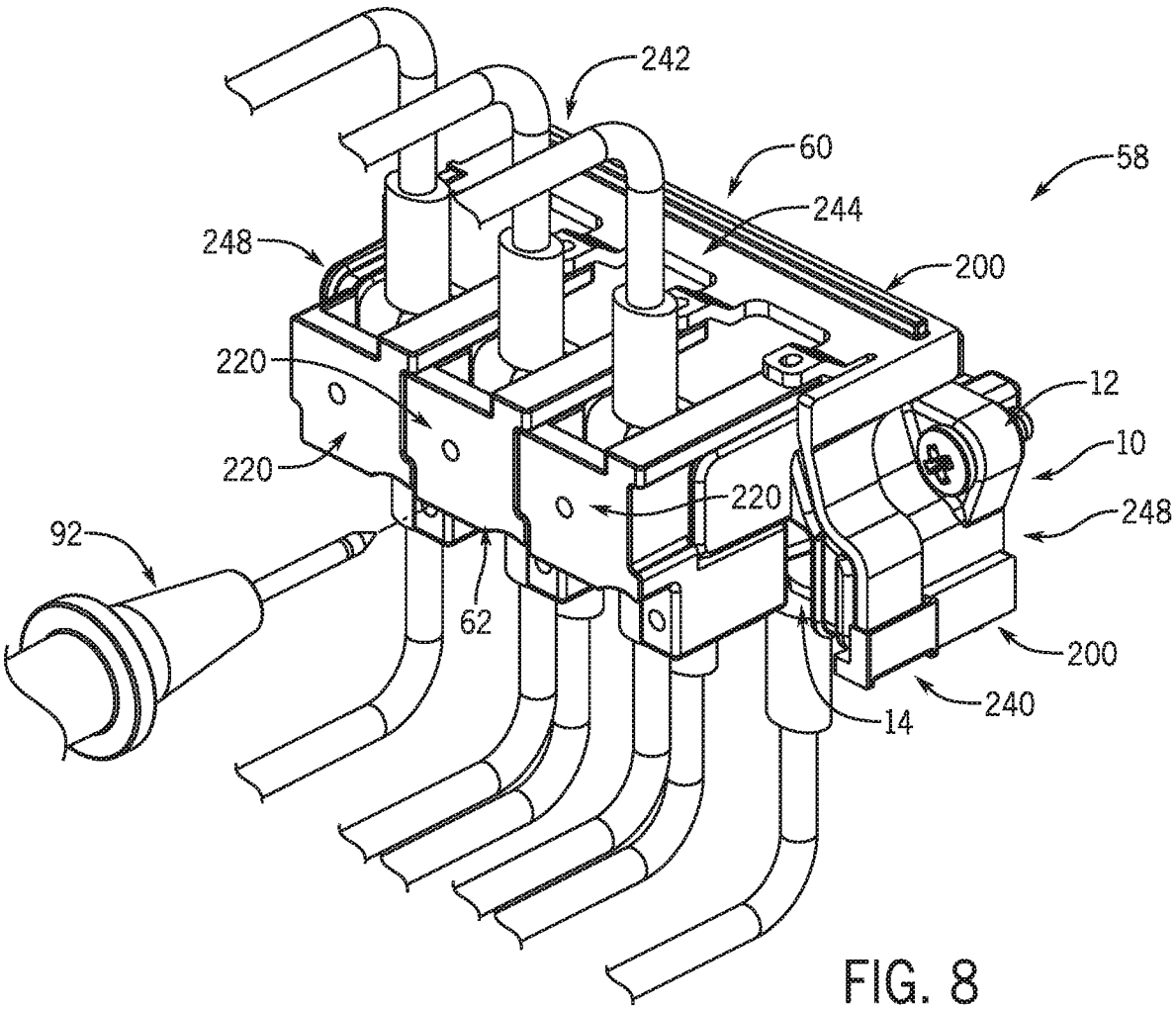
Figure 9:
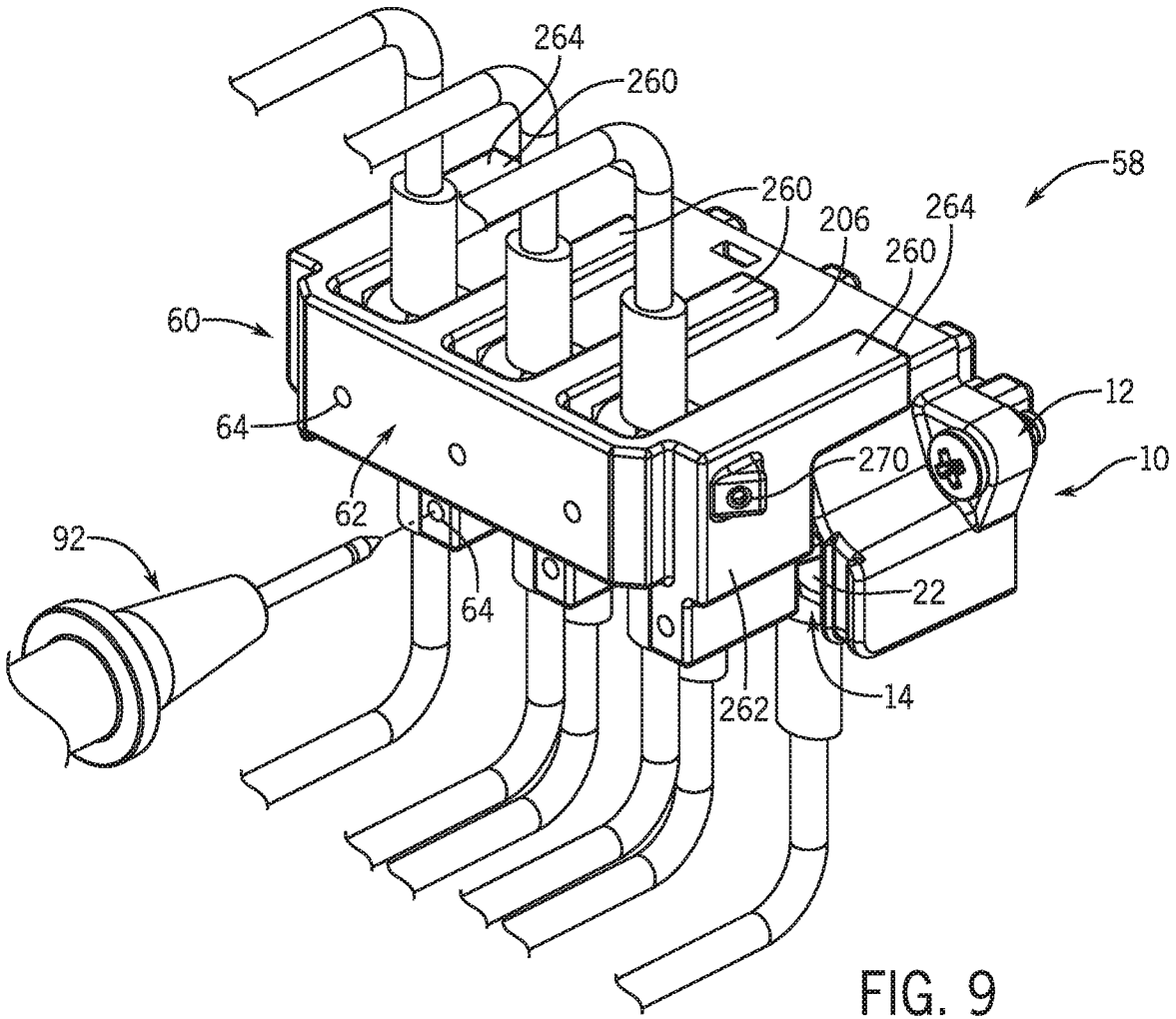

FIG. 8 is a perspective view of an example of the probe accessing the terminal block through the modular front panels of the probe-accessible cover, in accordance with an aspect of the present disclosure; and FIG. 9 is a perspective view of an example of the probe-accessible cover, which is a single piece that is friction-fit over the terminal block, in accordance with an aspect of the present disclosure.

DETAILED DESCRIPTION

One or more specific examples of the present disclosure will be described below. In an effort to provide a concise description of these examples, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

As set forth above, terminal blocks may be utilized to electrically couple various current-carrying components to one another. For example, certain terminal blocks are screw terminal connectors that utilize a conductive screw or other fastener to secure wires within terminals of the terminal blocks and complete various electrical circuits. Because the conductive screws may each carry a charge equal to the electrical circuits that the conductive screws are completing, certain terminal blocks may be fitted with a cover that prevents manual access to the conductive screws. Certain covers may also be designed with access holes or probing ports that enable a screwdriver used to install the conductive screws, or a probe used to evaluate electrical parameters of the conductive screws, to contact the conductive screws. However, access holes sized for the screwdriver may be too large to provide substantial protection to the terminals of the terminal block. Additionally, an operator tasked with taking measurements of the terminals may perform a measurement operation to collect data regarding each terminal of the terminal block, which may become a lengthy or tedious process in situations in which the terminal block includes a significant number of terminals or in which multiple terminal blocks are analyzed. Moreover, these existing covers may enable the operator to use a probe to unintentionally electrically couple together, or short, two terminals, increasing a complexity of the measurement operation.

Accordingly, the present disclosure is directed to an improved cover for a terminal block that provides guided probe access to individual terminals of a terminal block, while reducing the potential for shorting the terminals. As will be understood, the cover includes a cover plate having access holes that are defined therethrough and sized to receive a probe, which may be a pin probe in certain examples. Notably, a number of probe guides, which corresponds to the number of terminals and the number of access holes, are formed with or coupled to the cover plate. The probe guides are hollow structures or channels, such as cylinders, cantilevers, or cones, that efficiently guide the manual insertion of the probe to a position in which the probe contacts a particular terminal for analysis. Walls of each probe guide may also block unintentional shorting of the terminal block by enabling only one terminal to be accessed by the probe at a time. Certain examples of the probe guide may also retain the probe in an operating position via an interference fit and/or by cantilever action, as discussed below. The cover therefore enables improved terminal protection and efficient measurement operations; for example, operators may be free to use their hands for additional tasks while the probe is analyzing a respective terminal of the terminal block.

Figure 1:
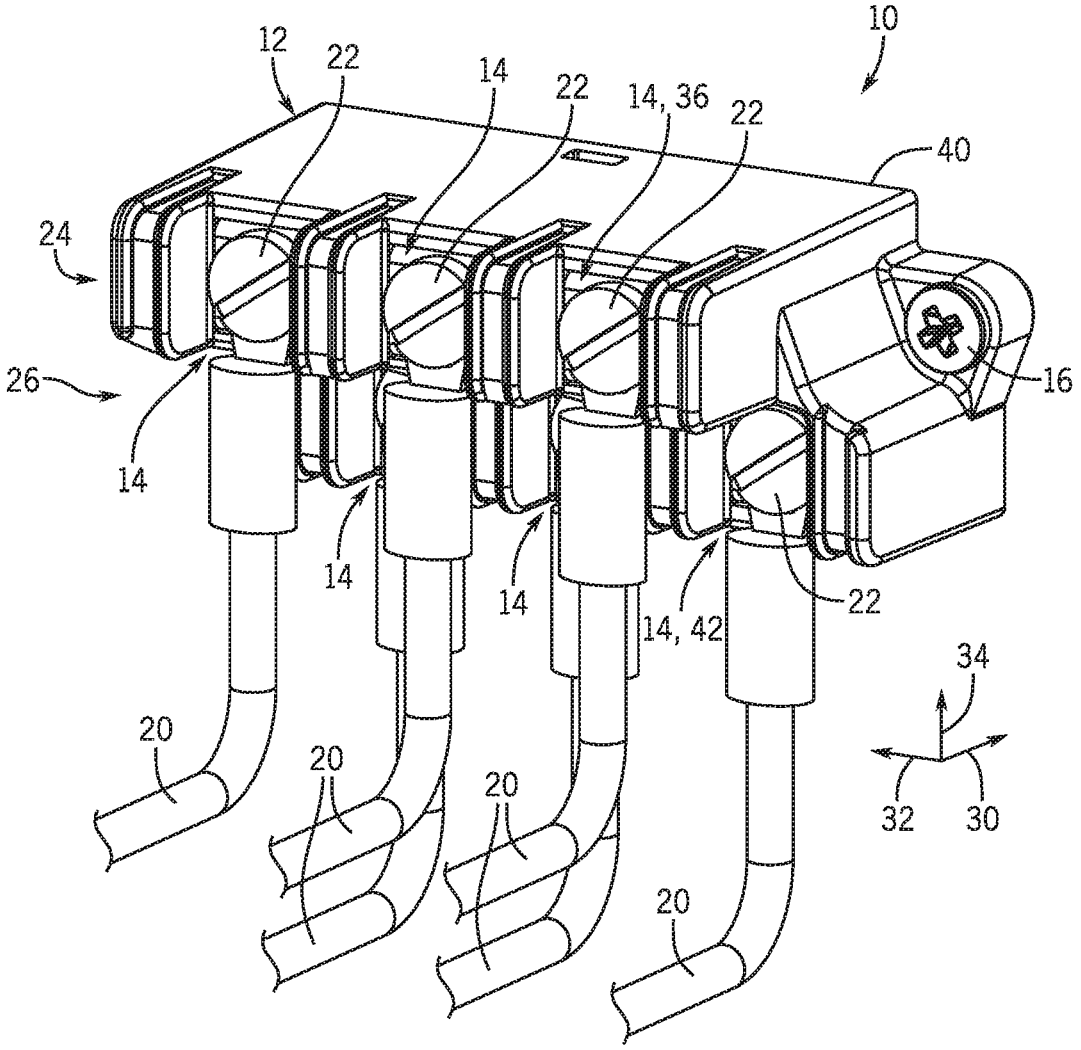
FIG. 1 is a perspective view of an example of a terminal block, in accordance with an aspect of the present disclosure.

With the foregoing in mind, FIG. 1 is a perspective view of an example of a terminal block 10 that may be fitted with a probe-accessible cover. As shown in the illustrated example of FIG. 1, the terminal block 10 includes a housing 12 having multiple terminals 14 disposed therein. Generally, the terminal block 10 is an interface that enables one or multiple electrical components to be coupled together to complete respective circuits therebetween, with more structural securement than certain wire-to-wire connections. In some examples, the terminal block 10 may include one or more securement fasteners 16 to secure the housing 12 of the terminal block 10 to another component. For example, the terminal block 10 may be positioned in an electrical cabinet and secured to the electrical cabinet and/or a component within the electrical cabinet via the one or more securement fasteners 16. The securement fasteners 16 may block movement of the terminal block 10 with respect to the electrical cabinet, which may reduce inadvertent movement of components within the housing 12 and/or reduce inadvertent disconnection of electrical components of the terminal block 10.

The terminal block 10 is a screw terminal connector in the illustrated example, in which each terminal 14 is coupled to a wire 20 via a suitable conductive fastener 22, such as a screw. In some examples, the fasteners 22 may be loosened and/or tightened using a tool (e.g., a screwdriver) to facilitate coupling of the wires 20 to the terminal block 10. It should be understood that the terminal block 10 may receive any other suitable electrical connectors and/or fasteners in other examples, such as ring terminals. To enable the multiple wires 20 to be efficiently coupled to the multiple terminals 14, the terminals 14 are arranged in the present example within a first row 24 that is offset from a second row 26 along each of a longitudinal axis 30, a lateral axis 32, and a vertical axis 34 of the terminal block 10. For example, a first terminal 36 of the first row 24 is positioned above, to the side, and further from a back surface 40 of the housing 12 than a second terminal 42 of the second row 26. However, the terminals 14 may have any suitable relative positioning to one another, in other examples. Additionally, although six terminals 14 are illustrated, other examples may include any suitable number of terminals, including hundreds of terminals 14 arranged in a substantially planar manner. It should also be understood that the features discussed below may be incorporated in any other suitable electrical component other than the illustrated screw terminal connector. In any case, as will be understood, the terminal block 10 may be advantageously fit with a cover that protects the terminals 14 while enabling guided probe access to the terminals 14.

Figure 2:
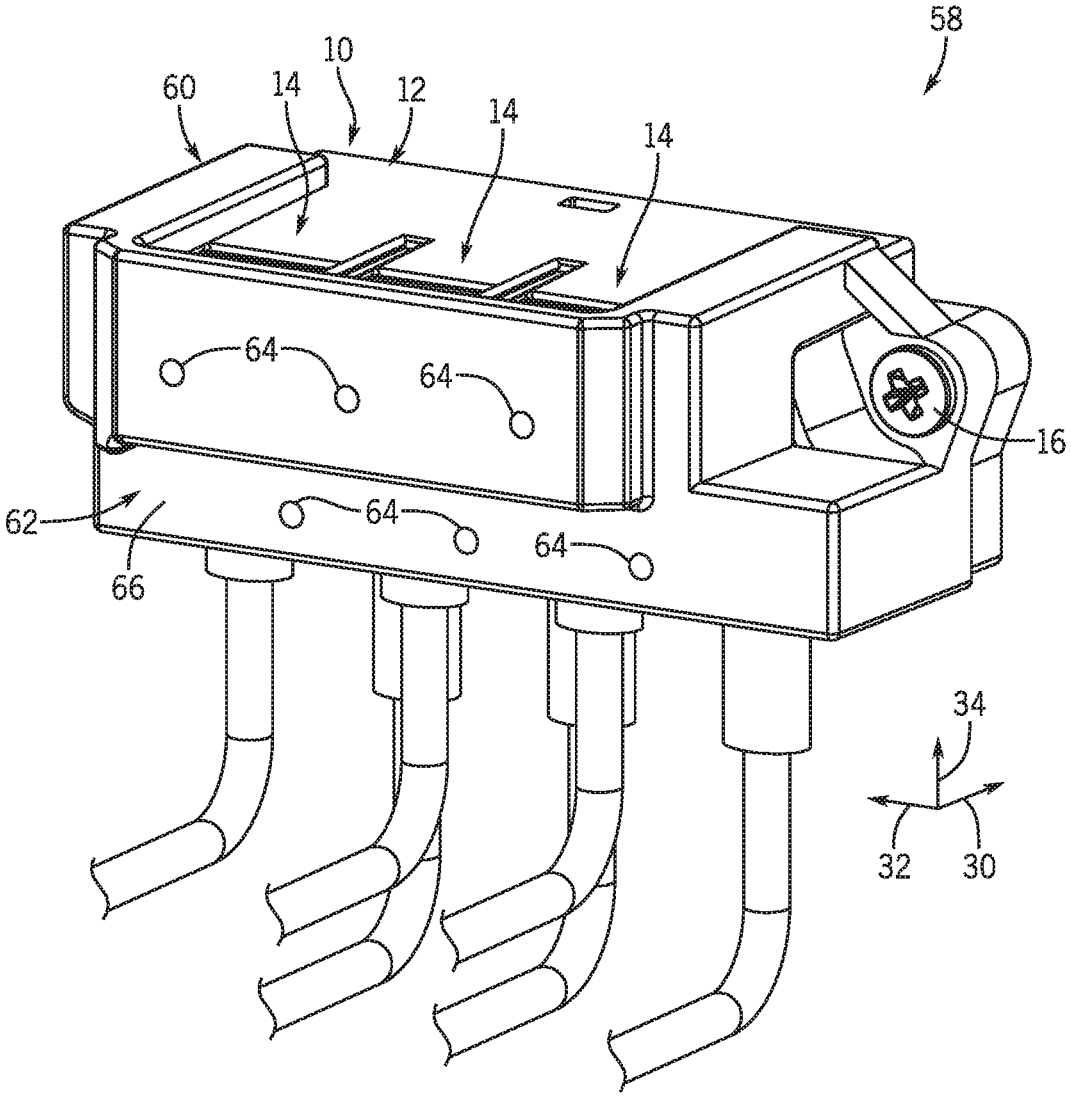
FIG. 2 is a perspective view of an example of the terminal block having a probe-accessible cover, in accordance with an aspect of the present disclosure.

FIG. 2 is a perspective view of an example of a terminal block assembly 58, which includes the terminal block 10 having a cover 60 (e.g., a probe-guiding cover) that is disposed over the housing 12. The cover 60 may be coupled to the terminal block 10 to reduce exposure of the terminals 14 that may otherwise enable access to the terminals 14 and/or unintentional shorting or contact of the terminals 14. The cover 60 may be formed of plastic or any other suitable, non-conductive material that provides protection to the terminals 14. In some examples, the cover 60 and the features of the cover 60 discussed herein are formed via injection molding processes. In the present example, the cover 60 is retained to the housing 12 of the terminal block 10 via the securement fasteners 16, which may be longer than the securement fasteners 16 of FIG. 1 that are not designed to retain the cover 60 over the housing 12. Increasing the length of the securement fasteners 16 enables the securement fasteners 16 to secure the cover 60 to the housing 12 and to secure the housing 12 to another structure (e.g., an electrical cabinet). As discussed in later examples, the cover 60 may be retained over the housing 12 by any suitable fasteners, retainers, or features of terminal block assembly 58.

Notably, the cover 60 has a cover plate 62 that is disposed directly over the terminals 14 of the terminal block 10. Moreover, access holes 64 are formed through a main body 66 of the cover plate 62, thus enabling a probe (e.g., a pin probe) to access and analyze the electrical connections of the terminals 14. For example, six access holes 64 are formed through the main body 66 to correspond to the six terminals 14 of the present example, though any suitable number of access holes 64 may be provided that correspond to a number of the terminals 14 of the terminal block 10. Although illustrated with three of the access holes 64 disposed at distance along the longitudinal axis 30 relative to the remaining three of the access holes 64, it should be understood that the cover plate 62 may alternatively define each of the access holes 64 at a common position along the longitudinal axis 30 (e.g., be substantially planar). The access holes 64 are sized to receive a probe and to block access to the terminals 14 via a tool or screwdriver used to actuate the fasteners 22. As will be understood, the cover 60 also includes features that guide and/or retain the probe within the access holes 64 to enable enhanced measurement operations.

Figure 3:
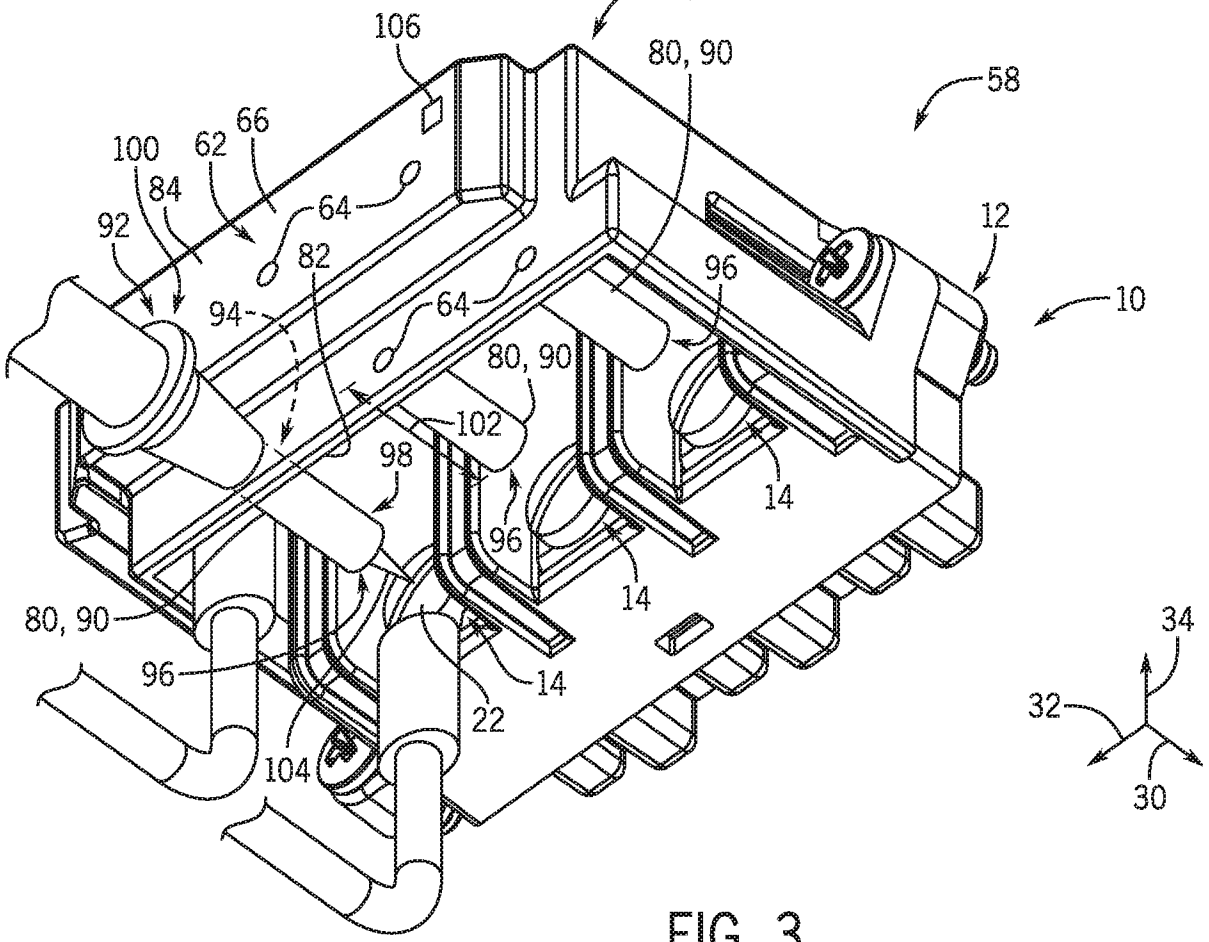
FIG. 3 is a bottom perspective view of an example of a probe accessing the terminal block through the probe-accessible cover, in accordance with an aspect of the present disclosure.

For example, FIG. 3 is a bottom perspective view of an example of the terminal block assembly 58 in which the cover 60 includes probe guides 80 extending from a back surface 82 of the main body 66 of the cover plate 62. The back surface 82, which is on an opposite side of the main body 66 from a front surface 84, faces the terminals 14 of the terminal block 10. The probe guides 80 have guide structures that are open cylinders 90 (e.g., annular or hollow cylinders, channels) in the present example, which facilitate the positioning of a probe 92 (e.g., a pin probe) in contact with the fasteners 22 of the terminals 14. In more detail, one of the access holes 64 is positioned at a proximal longitudinal end 94 of each open cylinder 90, and a guide hole 96 is defined through a distal longitudinal end 98 of each open cylinder 90. The probe guides 80 of the cover 60 therefore enable the probe 92 to be efficiently guided into an illustrated operating position 100 or sensing position to analyze the terminals 14. For example, an operator may direct the probe 92 through one of the access holes 64, along a length 102 of the corresponding probe guide 80, and out of the guide hole 96 of the probe guide 80 to reach the illustrated operating position 100. The probe guides 80 may guide the probe 92 toward a corresponding terminal 14 and block the probe 92 from contacting another terminal 14 not associated with a particular probe guide 80. As such, the probe 92 may be blocked from contacting more than one terminal 14 at a time, thereby reducing the likelihood of a short circuit during a measurement operation.

Although only three probe guides 80 are visible, it should be understood that the cover 60 may include one probe guide 80 for each access hole 64 to enable probe access to each terminal 14 of the terminal block 10. Moreover, the probe guides 80 that correspond to the first row 24 of terminals 14 may be shorter than the probe guides 80 that correspond to the second row 26 of terminals, enabling individualized probe access that is tailored for the respective distance between each row 24, 26 and the cover plate 62. Additionally, as illustrated in the present example, the cover plate 62 may include a stepped portion that positions the access holes 64 for the first row 24 of terminals 14 further from the housing 12 than a remaining non-stepped portion of the cover plate 62, thus enabling efficient construction of the probe guides 80 for each terminal 14 that have a substantially similar length 102.

In some examples, including certain examples discussed below, the probe guides 80 are sized and/or positioned to retain the probe 92 in the operating position 100. For example, a channel within each probe guide 80 may be sized to contact an outer surface 104 of the probe 92 and retain the probe 92 via an interference fit, such that a minor amount of manual force is utilized to place the probe 92 within or remove the probe 92 from the cover 60. In other examples, the probe guides 80 may be angled downward relative to a normal plane 106 of the cover plate 62 (e.g., defined between the vertical axis 34 and the lateral axis 32), such that an upper surface of the probe 92 is leveraged into contact with an inner surface of the probe guide 80 to retain the probe 92 therein. As recognized herein, in such examples, the cover 60 enables the operator to position the probe 92 in the operating position 100 and then have available hands to perform additional functions associated with a given measurement process. For example, instead of manually holding the probe 92 in place through a cover without probe guides, the operator may have both hands available to manually record measurements output by a display associated with the probe 92, thereby efficiently expediting the measurement process performed on the multiple terminals 14 of the terminal block 10.

Figure 4:
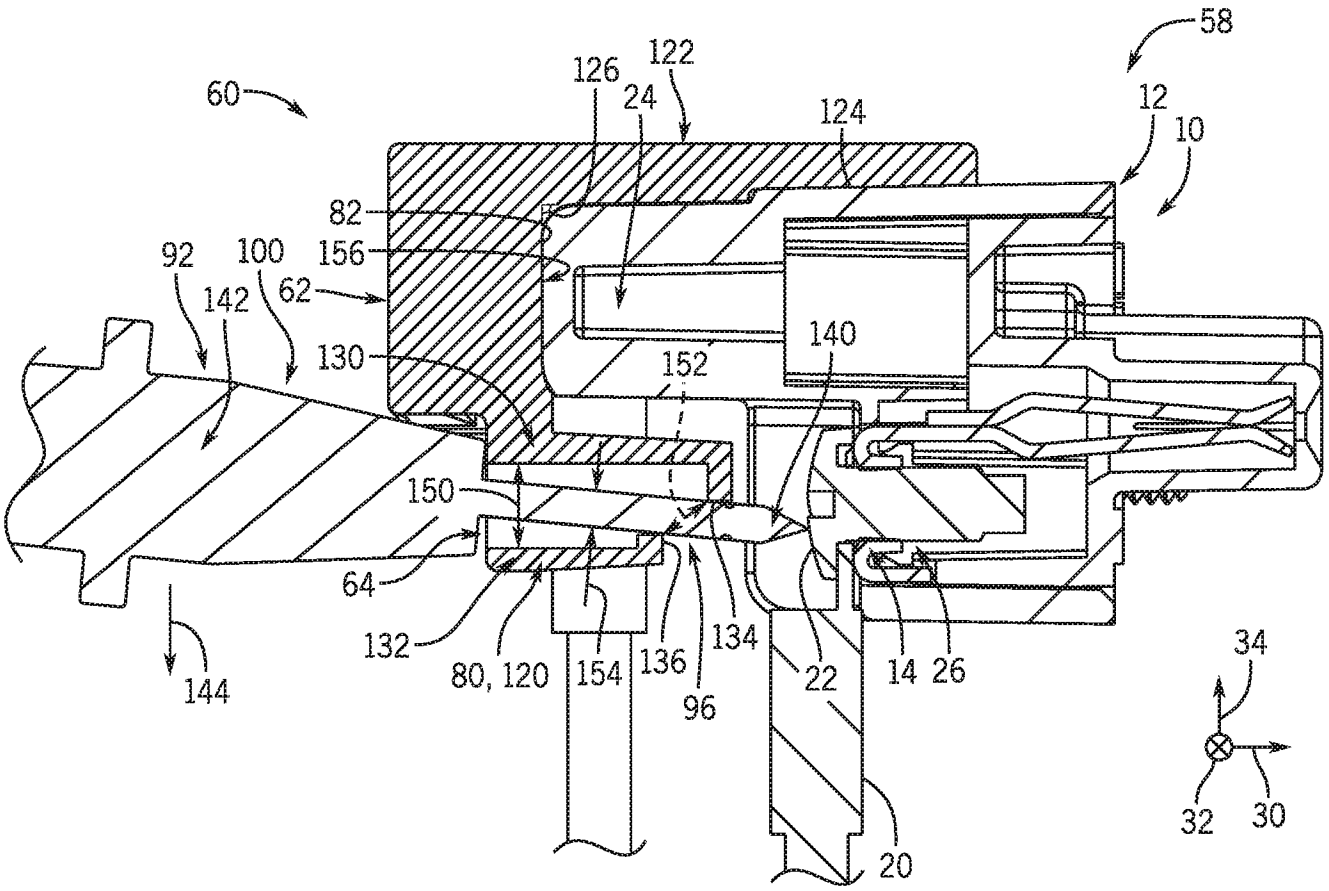
FIG. 4 is a side cross-sectional view of an example of the probe-accessible cover guiding the probe to the terminal block, in accordance with an aspect of the present disclosure.

As another example, FIG. 4 is a cross-sectional diagram of an example of the terminal block assembly 58, in which the cover plate 62 includes probe guides 80 that are cantilever retainers 120. As illustrated, the cover plate 62 of the cover 60 is integrally formed with an upper support plate 122 that contacts an upper surface 124 of the terminal block 10. The cover plate 62 extends from the upper support plate 122 at an angle 126 that enables the present examples of the probe guides 80 to align with the terminals 14. In the present example, each of the cantilever retainers 120 includes a guide structure that is defined by an L-shaped extension 130 and a linear extension 132 protruding from the back surface 82 of the cover plate 62 around one of the access holes 64. In particular, the L-shaped extension 130 is disposed above the access hole 64 relative to the vertical axis 34 along a first side of the access hole 64, and the linear extension 132 is disposed below the access hole 64 relative to the vertical axis 34 along a second side of the access hole 64.

Each probe guide 80 of the present example defines a respective guide hole 96 between a distal end 134 of the L-shaped extension 130 and a distal end 136 of the linear extension 132. The guide hole 96 is therefore spaced from the back surface 82 of the cover plate 62 and enables the cantilever retainer 120 to reversibly retain or balance the probe 92 at the illustrated operating position 100, in which a tip 140 of the probe 92 contacts the fastener 22 of the terminal 14. That is, as a force (e.g., gravitational force) applied to a main body 142 of the probe 92 attempts to move the probe 92 downward along a direction 144, the tip 140 of the probe 92 operates as a fulcrum against the distal end 134 of the L-shaped extension 130, retaining the probe 92 in place. The probe 92 may therefore efficiently analyze the electrical connection between the wire 20 and the terminal 14, while blocking unintentional shorts of other terminals 14. Additionally, a length 150 (e.g., diameter) of the access hole 64 and a length 152 of the guide hole 96 are sized to receive the pin probe 92 having an illustrated diameter 154. The lengths 150, 152 may also be designed to prevent a tool or screwdriver from being inserted into the guide hole 96 to actuate the fasteners 22 of the terminal 14, providing additional security to the terminal block 10.

It should be understood that the present example of the terminal block assembly 58 is illustrative of one of multiple configurations of the terminal block assembly 58. As such, in other examples, the L-shaped extension 130 and/or the linear extension 132 of the cover plate 62 may have any other suitable profiles, such as curved profiles, that cooperate to guide and/or retain the probe 92 within the access holes 64. Moreover, although illustrated with an upper portion 156 of the back surface 82 of the cover plate 62 contacting the housing 12 of the terminal block 10, it should be understood that the cover plate 62 may be spaced from the housing 12 in other examples and include probe guides 80 that are suitably sized to enable guided probe access to the first row 24 of terminals 14, which is above the second row 26 of terminals 14 with respect to the vertical axis 34.

Figure 5:
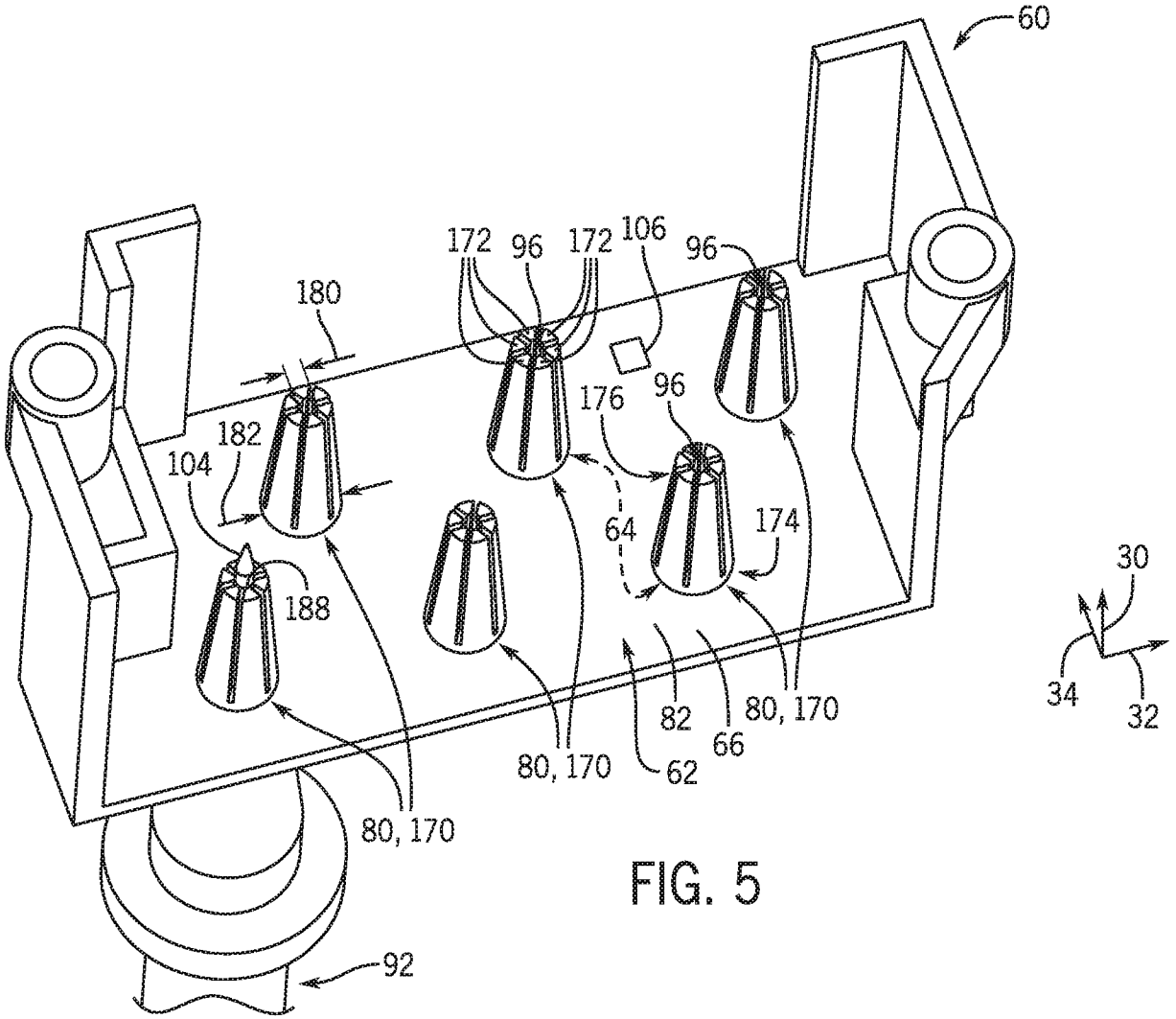
FIG. 5 is a perspective view of an example of the probe-accessible cover guiding the probe to a sensing position, in accordance with an aspect of the present disclosure.

FIG. 5 is a perspective view of an example of the cover 60 having probe guides 80 that are truncated cones 170 extending from the back surface 82 of the cover plate 62. In more detail, each truncated cone 170 is a hollow structure formed from six segments 172 that extend from the back surface 82 of the cover plate 62 along the longitudinal axis 30 of the cover 60. The segments 172 each define a portion of a variable circumference of each respective truncated cone 170, such that longitudinally extending spaces are formed between adjacent walls of each segment 172. In the present example, a proximal end 174 of each truncated cone 170 is positioned around one of the access holes 64 defined through the main body 66 of the cover plate 62, and a distal end 176 of each truncated cone 170 defines a respective guide hole 96. The guide holes 96 have a smaller diameter 180 than a diameter 182 of the access holes 64, such that the truncated cones 170 are tapered along the longitudinal axis 30. The tapered formation of the truncated cones 170 enables the cover 60 to efficiently receive and direct (e.g., funnel) the probe 92 to the above-discussed operating position 100. Additionally, an inner edge 188 of each segment 172 of the truncated cones 170 may contact the outer surface 104 of the probe 92 and cooperatively retain the probe 92 in the operating position 100 via friction and/or by biasing against the outer surface 104 of the probe 92.

Although discussed with reference to the probe guides 80 being disposed or formed on the back surface 82 of the cover plate 62, it should be understood that, in other examples, the probe guides 80 are formed on the front surface 84 to guide the pin probe 92 through a respective one of the access holes 64. Such examples of the cover 60 may also retain the probe 92 in the operating position via any suitable retaining features, including those that are generally a mirror image (e.g., with respect to the normal plane 106 formed between the lateral axis 32 and the vertical axis 34) of the examples of the cover 60 discussed above. Additionally, the configurations of the probe guides 80 and other portions of the cover 60 discussed herein are not limiting, such that other open structures suitable for guiding and/or retaining the pin probe 92 are presently contemplated. Moreover, while the cover 60 has been generally introduced as having the securement fasteners 16 for coupling the cover 60 to the terminal block 10, it should be recognized that the cover 60 may include any suitable shape or configuration corresponding to the shape or configuration of the terminal block 10. Indeed, other non-limiting examples of the cover 60 having alternative features for coupling to the terminal block 10 are discussed with reference to FIGS. 6-9 below.

Figure 6:
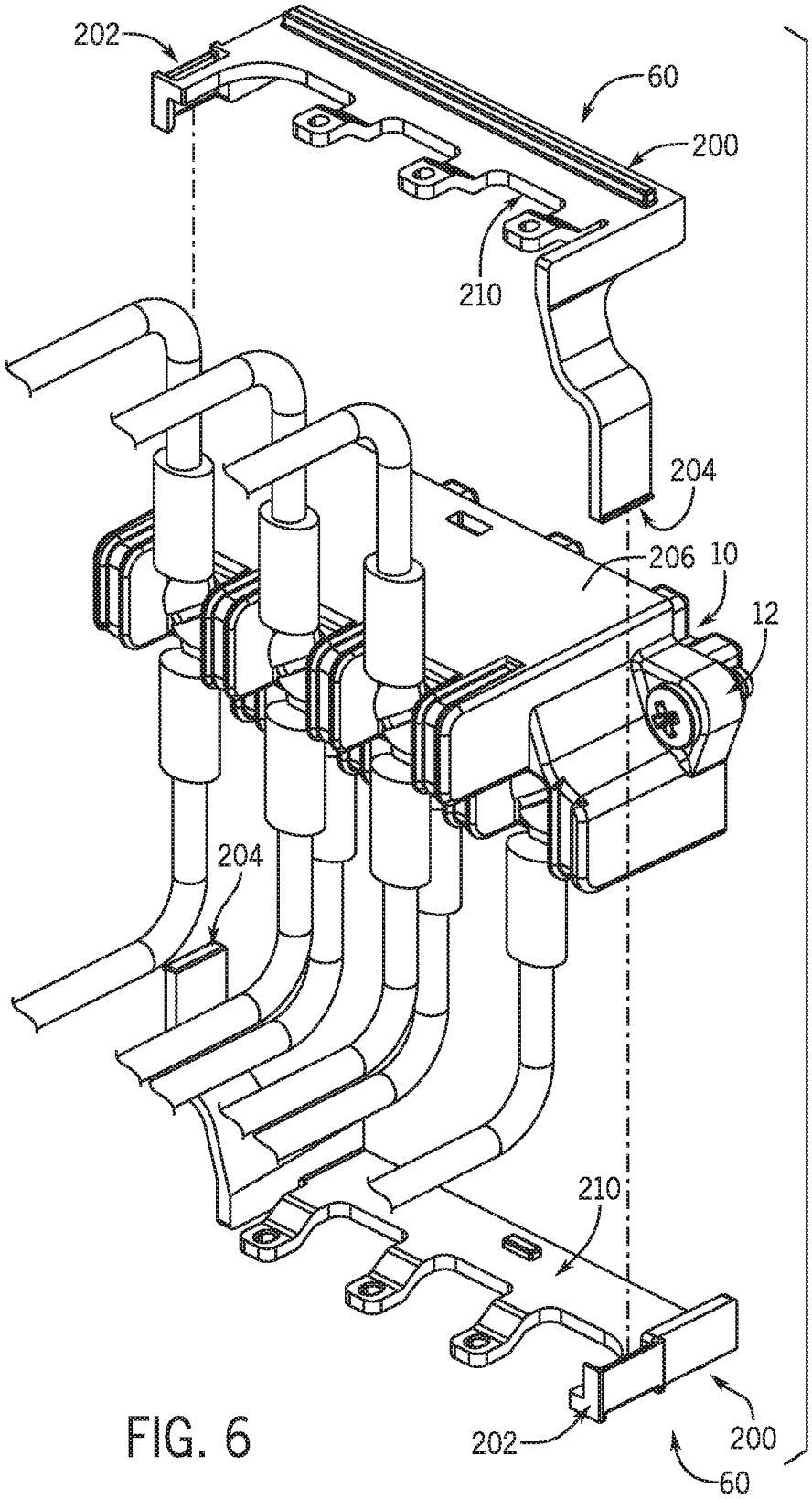
FIG. 6 is an exploded perspective view of an example of a first retaining portion and a second retaining portion of the probe-accessible cover fitting around the terminal block, in accordance with an aspect of the present disclosure.

FIG. 6 is an exploded perspective view of an example of retaining portions 200 (e.g., perimeter supports, perimeter support assembly) of the cover 60 fitting around the terminal block 10. In particular, one retaining portion 200 is aligned with a first portion of a perimeter of the housing 12 of the terminal block 10, and the other retaining portion 200 is aligned with a remaining portion of the perimeter of the housing 12. The retaining portions 200 have an identical shape to one another (e.g., within the bounds of manufacturing tolerances), thus enabling the retaining portions 200 to be interchangeable with one another and reduce a complexity of a manufacturing process for the cover 60. The retaining portions 200 each include a receiving coupler 202 and a protruding coupler 204 designed to snap-fit with the receiving coupler 202 of an additional retaining portion 200. As such, the retaining portions 200 may be aligned with an outer surface 206 of the housing 12 of the terminal block 10 and coupled to one another via the receiving couplers 202 and the protruding couplers 204. It should be understood that, as illustrated, a terminal-facing surface 210 of each retaining portion 200 may be formed to correspond to the outer surface 206 of the housing 12 of any suitable terminal block 10.

Figure 7:
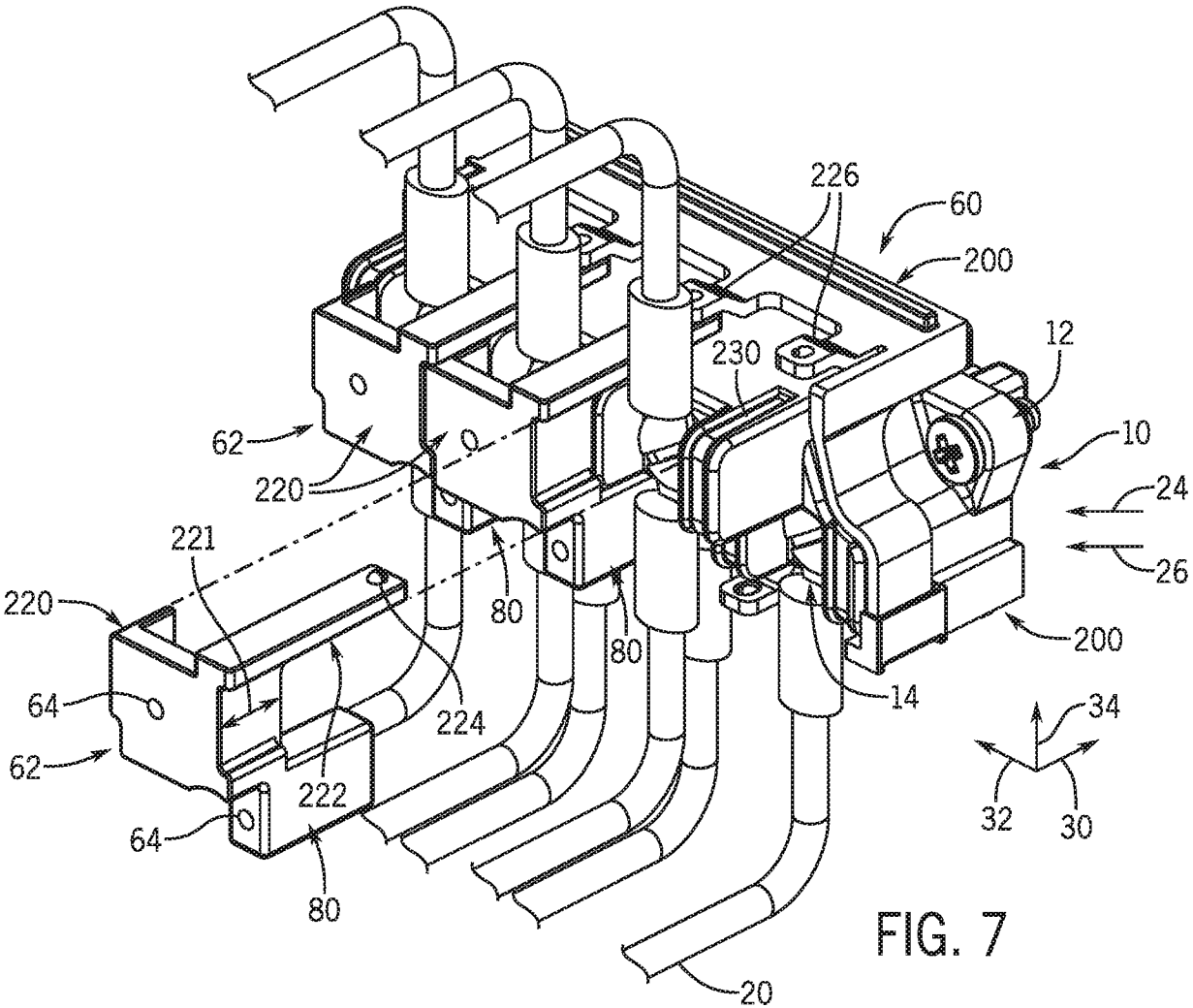
FIG. 7 is a partially exploded perspective view of an example of the first retaining portion and the second retaining portion receiving modular front panels of the probe-accessible cover, in accordance with an aspect of the present disclosure.

FIG. 7 is a partially exploded perspective view of an example of the retaining portions 200 assembled around the terminal block 10 to receive modular front panels 220 (e.g., cover plate modules), which may collectively form the cover plate 62 discussed above. The modular front panels 220 each include two access holes 64 in the present example, one or both of which may be integrally formed with a respective probe guide 80, as discussed above. For example, the modular front panels 220 each presently include one probe guide 80 that aligns with one of the terminals 14 of the second row 26. In some examples, a thickness 221 of the modular front panels 220 also operates as a probe guide 80 that contacts or seals against the terminals 14 of the first row 24. In other examples, the modular front panels 220 include a probe guide 80 having a specific length (e.g., defined along the longitudinal axis 30) that corresponds to any suitable arrangement of terminals 14.

Additionally, the modular front panels 220 each include one or multiple coupling arms 222 that each have a vertically extending protrusion 224. Thus, the protrusions 224 of the coupling arms 222 may align and couple with bent arms 226 of the retaining portions 200 to assemble the cover plate 62 in front of the terminals 14 without physically interfering with the wires 20 extending from the terminal block 10. In the present example, the coupling arms 222 of the modular front panels 220 may be slid over grooves 230 of the housing 12 that are formed between the terminals 14, increasing a structural integrity of the cover 60 by reducing the potential for sideways movement of the modular front panels 220.

As illustrated in the example terminal block assembly 58 of FIG. 8, the pin probe 92 may therefore access the terminals 14 of the terminal block 10 though the modular front panels 220 of the cover plate 62. Because the cover plate of the cover 60 is formed via the modular front panels 220, the cover plate 62 may be efficiently adapted for terminal blocks 10 of varying dimensions without manufacturing a specific cover plate 62 for each set of dimensions. It is noted that, in other examples, the modular front panels 220 and/or the retaining portions 200 may have any other suitable, corresponding shapes or configurations. For example, instead of coupling the retaining portions 200 to one another near a first corner 240 and a second corner 242 of the housing 12, the retaining portions 200 may be designed to couple to one another at an upper center point 244 and a lower center point of the housing 12. Additionally, the modular front panels 220 of other examples may form horizontally extending segments instead of the present vertically extending segments of the cover plate 62, such that the horizontally extending segments are coupled to the retaining portions 200 near lateral sides 248 of the housing 12.

As another example, FIG. 9 is a perspective view of the terminal block assembly 58 having the cover 60, which may have probe guides 80 of any suitable shape, including the open cylindrical shape, the open truncated cone shape, or the cantilever shape discussed above. Notably, the cover 60 is illustrated as a single, unitary piece that is friction-fit over the terminal block 10. The cover 60 may be formed from injection-molded plastic, as mentioned above. In particular, the cover plate 62 is retained over the terminals 14 of the terminal block 10 via coupling arms 260 that may align with the above-discussed grooves 230 of the housing 12. The probe 92 may therefore be inserted through the access holes 64 and directed via probe guides 80 into contact with the fasteners 22 of the terminals 14. In certain examples, a side surface 262 of laterally-outward coupling arms 264 of the cover 60 receives one or multiple cover securement fasteners 270, such as screws. The cover securement fasteners 270 may therefore further secure the cover 60 to the housing 12 by frictionally contacting the outer surface 206 of the housing 12 or by coupling to receiving features of the housing 12.

Technical effects of the present examples include a probe-accessible cover having probe guides that enable a probe to analyze terminals of a terminal block, while blocking exposure of the terminals and/or blocking actuation of the terminals via tools larger than the probe. In particular, the cover includes a cover plate having access holes that are defined therethrough. The probe guides each protrude from the cover plate around a respective one of the access holes and provide a hollow structure (e.g., a channel or opening) that enables positioning of the probe into an operating position. The probe guides may include an open cylindrical shape, a cantilever retainer shape, an open truncated cone shape, and so forth that respectively direct the probe into contact with a particular terminal while physically restricting access to other terminals, thereby reducing shorting of the terminal block. Certain probe guides may also retain the probe in the operating position, facilitating measurement operations by reducing the manual effort typically utilized to hold the probe in a desired position.

The examples set forth in the present disclosure may be susceptible to various modifications and alternative forms, specific examples have been shown by way of example in the drawings and have been described in detail herein. However, it may be understood that the disclosure is not intended to be limited to the particular forms disclosed. The disclosure is to cover all modifications, equivalents, and alternatives falling within the spirit and scope of the disclosure as defined by the following appended claims. In addition, the techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). For any claims containing elements designated in any other manner, however, it is intended that such elements are not to be interpreted under 35 U.S.C. 112(f).

The invention claimed is:

1. A cover for a terminal block, comprising:

a cover plate configured to be disposed over a plurality of terminals of the terminal block, wherein the cover plate comprises:

a first surface;

a second surface configured to face the plurality of terminals; and a plurality of access holes extending between the first surface and the second surface, wherein each of the plurality of access holes enables access to a respective terminal of the plurality of terminals through the cover plate;

a plurality of probe guides extending from the second surface of the cover plate toward respective access holes of the plurality of access holes, wherein each probe guide of the plurality of probe guides comprises a channel configured to guide a probe to an operating position that enables the probe to analyze the respective terminal of the plurality of terminals;

a first perimeter support; and a second perimeter support configured to couple to the first perimeter support around a perimeter of the terminal block, wherein the first perimeter support and the second perimeter support are configured to retain the cover plate over the plurality of terminals.

2. The cover of claim 1, wherein each of the plurality of probe guides is configured to retain the probe in the operating position for a duration of a measurement operation.

3. The cover of claim 1, wherein each of the plurality of probe guides is configured to enable the probe to analyze the respective terminal of the plurality of terminals while blocking access to remaining terminals of the plurality of terminals.

4. The cover of claim 1, wherein the channel of each probe guide of the plurality of probe guides comprises a cylindrical shape comprising:

a respective access hole of the plurality of access holes positioned at a first longitudinal end of the channel; and a guide hole positioned at a second longitudinal end of the channel, opposite the first longitudinal end.

5. The cover of claim 1, wherein the channel of each probe guide of the plurality of probe guides comprises a cantilever retainer comprising:

an L-shaped extension that protrudes from the second surface of the cover plate along a first side of a respective access hole of the plurality of access holes; and a linear extension that protrudes from the second surface of the cover plate along a second side of the respective access hole of the plurality of access holes, wherein the cantilever retainer is configured to balance the probe within a guide hole defined between a first distal end of the L-shaped extension and a second distal end of the linear extension.

6. The cover of claim 1, wherein the channel of each probe guide of the plurality of probe guides comprises a truncated cone comprising:

a respective access hole of the plurality of access holes positioned at a first longitudinal end of the truncated cone; and a guide hole positioned at a second longitudinal end of the truncated cone, opposite the first longitudinal end, wherein the guide hole comprises a diameter that is smaller than the respective access hole of the truncated cone.

7. The cover of claim 6, wherein the truncated cone is formed from a plurality of longitudinally extending segments that are cooperatively configured to receive and retain the probe in the operating position.

8. The cover of claim 1, wherein the cover is configured to couple to the terminal block via a friction fit.

9. The cover of claim 1, wherein the terminal block comprises a screw terminal connector configured to retain wires in the plurality of terminals via first fasteners, and wherein the cover is configured to be retained to the screw terminal connector by one or more second fasteners.

10. The cover of claim 1, wherein the cover plate comprises a plurality of cover plate modules configured to couple to the first perimeter support and the second perimeter support, and wherein each of the plurality of cover plate modules comprises a portion of the plurality of probe guides.

11. A terminal block assembly, comprising:

a terminal block comprising a plurality of terminals configured to be coupled to a plurality of wires;

a cover configured to be coupled to the terminal block, wherein the cover comprises a cover plate configured to be disposed over the plurality of terminals, and wherein the cover plate comprises:

a main body having a plurality of access holes defined therethrough; and a plurality of probe guides extending from the main body, wherein each probe guide of the plurality of probe guides comprises a guide structure, wherein the guide structure is formed around a respective access hole of the plurality of access holes at a first end of the guide structure and defines a guide hole at a second end of the guide structure, opposite the first end, and wherein each probe guide of the plurality of probe guides is configured to direct a probe through the respective access hole, through the respective guide hole, and into contact with a respective terminal of the plurality of terminals;

a first perimeter support; and a second perimeter support configured to couple to the first perimeter support around a perimeter of the terminal block, wherein the first perimeter support and the second perimeter support are configured to retain the cover plate over the plurality of terminals.

12. The terminal block assembly of claim 11, wherein each of the plurality of probe guides is configured to retain the probe in contact with the respective terminal of the plurality of terminals for a duration of a measurement operation.

13. The terminal block assembly of claim 11, wherein a first portion of the plurality of terminals are arranged in a first row, wherein a second portion of the plurality of terminals are arranged in a second row, and wherein the first row is vertically offset and longitudinally offset from the second row.

14. The terminal block assembly of claim 11, wherein the terminal block is a screw terminal connector, wherein the plurality of terminals comprises a plurality of conductive fasteners that are actuatable by a screwdriver, and wherein the plurality of access holes is configured to block the screwdriver from actuating the plurality of conductive fasteners.

15. The terminal block assembly of claim 11, wherein the guide structure of each probe guide of the plurality of probe guides comprises a cylindrical shape, an open truncated cone shape, or a cantilever shape.

16. A cover for a terminal block, comprising:

a cover plate configured to be disposed over a first terminal and a second terminal of the terminal block, wherein the cover plate comprises:

a main body comprising a first access hole and a second access hole defined therethrough, wherein the first access hole is configured to align with the first terminal and the second access hole is configured to align with the second terminal;

a first probe guide extending from a surface of the main body toward the first access hole;

a second probe guide extending from the surface of the main body toward the second access hole, wherein the first probe guide and the second probe guide are each configured to guide a probe to an operating position and retain the probe in the operating position to enable the probe to analyze the first terminal or the second terminal, respectively, for a duration of a measurement operation;

a first perimeter support; and a second perimeter support configured to couple to the first perimeter support around a perimeter of the terminal block, wherein the first perimeter support and the second perimeter support are configured to retain the cover plate over the plurality of terminals.

17. The cover of claim 16, wherein the first probe guide comprises a cylindrical shape or an open truncated cone shape to enable the probe to contact the first terminal and block the probe from contacting the second terminal.

18. The cover of claim 16, wherein the cover is a unitary piece formed from injection-molded plastic, and wherein the cover is configured to be retained to the terminal block via fasteners or a friction fit.

19. The cover of claim 16, comprising a perimeter support assembly configured to be disposed around a perimeter of the terminal block, wherein the perimeter support assembly is configured to couple to the cover plate and retain the cover plate over the first terminal and the second terminal.

* * * * *